United States Patent [19]

Hasselmann et al.

[11] 4,295,505

[45] Oct. 20, 1981

[54] GASOLINE VAPOR RECOVERY SYSTEM

[76] Inventors: Detlev E. M. Hasselmann, 519 S. Nardo Ave., Solana Beach, Calif. 92075; Paul D. Labonte, 9371 Fermi Ave., San Diego, Calif. 92123

[21] Appl. No.: 106,668

[22] Filed: Dec. 26, 1979

[51] Int. Cl.[3] ..... B65B 3/04

[52] U.S. Cl. ..... 141/301; 137/797; 220/89 A; 138/178; 251/282

[58] Field of Search ..... 141/37-64, 141/285-310, 198-229, 392; 137/100, 68 R, 71, 797; 251/282; 220/89 A; 138/177, 178

[56] References Cited

U.S. PATENT DOCUMENTS 3,388,746 6/1968 Lindberg ..... 137/68 R 4,047,548 9/1977 Wagner ..... 137/68 R 4,057,085 11/1977 Shihabi ..... 141/59

4,064,889 12/1977 Gayle et al. ..... 137/68 R

*Primary Examiner*—Houston S. Bell, Jr.

*Attorney, Agent, or Firm*—Brown & Martin

[57] ABSTRACT

A gasoline vapor recovery system which includes a gasoline pump, a gasoline dispenser, a gasoline line with a flow sensor in it, and a gasoline vapor line with a pressure responsive valve in it which is operated by differential pressurefrom the flow sensor. The flow sensor is located in the gas dispenser and the pressure responsive valve is located below the gas dispenser to eliminate one of the impact valves which were heretofore required to provide a safer construction.

5 Claims, 2 Drawing Figures

23
24
22
26
28
30
36
34
18
50
48
40
20
44
32
38
16
46
10
12
14

52
24
56
58
57
60
54
62
64
48
50
92
44
70
86
88
72
74
90
68
76
66
84
78
82
80

GASOLINE VAPOR RECOVERY SYSTEM

BACKGROUND OF THE INVENTION

This invention relates to the recovery of gasoline vapors from gasoline dispenser systems.

As smog conditions have gone from bad to worse in large cities, every effort has been made to reduce the amount of hydrocarbons released into the atmosphere from all sources. One relatively large source of atmospheric hydro-carbons is gasoline vapors expelled from the gasoline tanks of automoblies when they are being refueled. Before being refueled, the nearly empty gasoline tank is filled with gasoline vapor. As gasoline is being pumped into the empty tank, the gasoline vapor is pushed out of the tank and into the atmosphere through the clearance between the refueling nozzle and the gasoline inlet opening. Gasoline vapor released into the atmosphere in this manner amounts to 15% of the total hydro-carbons released from the tailpipes of automobiles. Therefore in recent years, efforts have been made to develop vapor recovery systems for preventing the gasoline vapors from being released into the atmopshere during refueling.

Basically, these systems involve creating a vapor seal over the gasoline inlet opening when the refueling nozzle is inserted therein and providing a vapor recovery conduit which extends from the nozzle to the underground gasoline storage tank so that the gasoline vapors are pushed or drawn into the storage tank during the refueling instead of being released into the atmosphere.

There are two different types of vapor recovery systems: The balanced system and the vacuum-assist system. The balanced system relies on the push exerted on the gasoline entering the gasoline tank and displacing the gasoline vapor which had previously filled the tank. This push is sufficient to move the vapors down the vapor recovery conduit into the underground gasoline storage tank. Since the volume of vapor displaced by gasoline entering the gasoline tank is equal to the volume left vacant by gasoline leaving the storage tank, there is always room in the storage tank for the displaced vapor.

The vacuum-assist system uses a vacuum or other assist means to draw the gasoline vapor into the underground storage tank. The balanced system requires a relatively tight vapor seal at the gasoline inlet opening to prevent any vapor from escaping into the atmosphere. Since a tight vapor seal is difficult to obtain on some cars, the balanced system is not as efficient as the vacuum-assist system. There are many small stations, however, where the efficiency of a vacuum-assist system is not required.

In both the balanced system and the vacuum-assist system, a valve is placed on the gasoline vapor line and means are provided for opening the valve when the gasoline is being dispensed and closing it when gasoline is not being dispensed so that the gasoline vapor recovery line is only open when gasoline is being dispensed. In some systems, the valve is operated by a switch which works on the dispenser switch. In other words, when the dispenser is turned on, the valve is turned on, and when the dispenser is turned off, the valve is turned off. In other systems, a flow sensor is placed somewhere in the gasoline line and to create a differential pressure which indicates the flow of gasoline through the line.

This differential pressure is used to turn the valve off and on.

This invention relates to gasoline recovery systems of either the balanced type or the vacuum-assist type which utilizes a flow sensor for opening and closing the valve in the gasoline vapor line. One prior art system of this type is disclosed in U.S. Pat. No. 4,057,085 issued on Nov. 8, 1977 to Marwan S. Shihabi. This systen has the flow sensor and the pressure responsive valve formed in a common housing which also houses the conduits which connect the pressure responsive valve to the flow sensor. This housing is mounted on the gasoline dispenser and is connected to the gasoline storage tank through conduits which require impact valves at their lower portion as a safety measure. The impact valves turn off in response to the impact of a car crashing into the dispenser to cut off the flow of gas and to close the gasoline vapor recovery line.

SUMMARY OF THE INVENTION

In accordance with this invention, the prior art system is improved by separating the flow sensor and pressure responsive valve in two separate items which are connected together by frangible conduits and by mounting the pressure responsive valve below the gasoline dispensor so that no impact valve is required on the gasoline vapor recovery line. The reason that no impact valve is required is that in case an automobile should crash into the dispenser, the frangible conduits connecting the flow sensor to the pressure responsive valve will break and disconnect the inputs to the pressure responsive valve and allow it to shut off. The pressure responsive valve is of a type which is normally turned off and requires a differential pressure to turn it on.

In addition, the construction of this invention considerably reduces the cost of the vapor recovery system. It is estimated that a system based upon U.S. Pat. No. 4,057,085 will cost in the neighborhood of $10,000, and a system constructed in accordance with this invention will cost approximately $8,000.

DESCRIPTION OF THE PREFERRED EMBODIMENT

Figure 1:
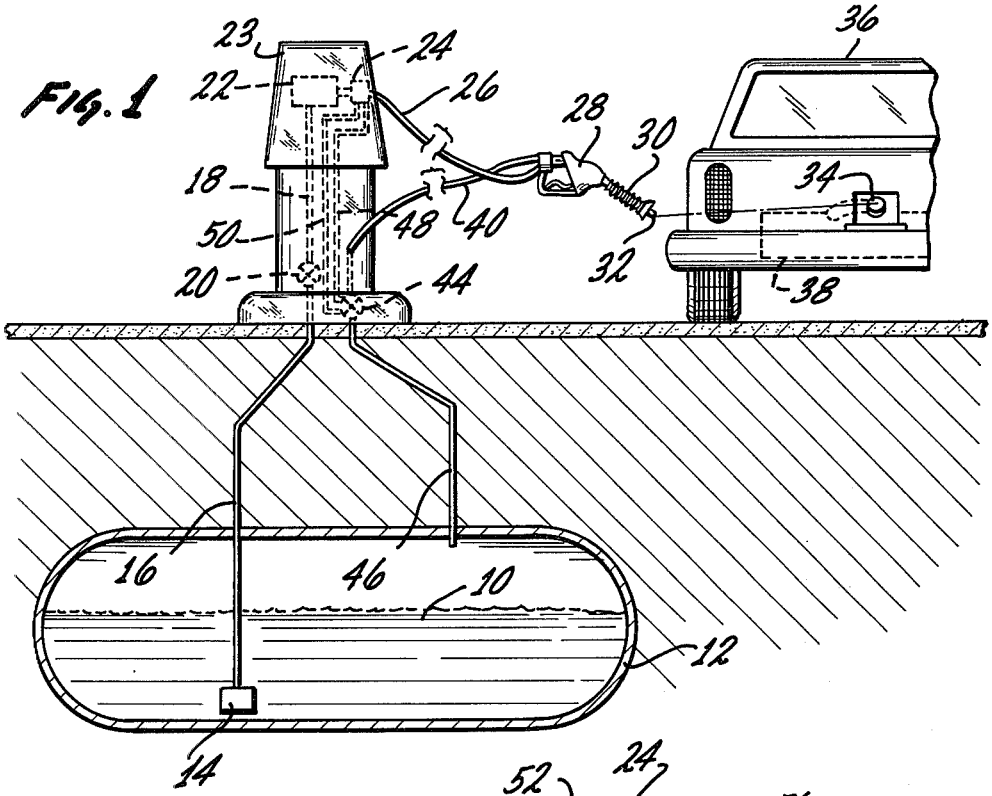
FIG. 1 is a diagrammatic representation of one embodiment of the invention.

Referring to FIG. 1, gasoline 10 is pumped out of an underground storage tank 12 by a submersible pump 14 via conduits 16 and 18, which are separated at their junction by an impact valve 20. Conduit 18 is coupled to the meter 22 of a gasoline dispenser 23. Meter 22 in turn is coupled to a flow sensor 24. Flow sensor 24 is coupled to a gasoline delivery hose 26 which has a vapor recovery nozzle 28 on its other end. Vapor recovery nozzle 28 has a resilient boot 30 which covers its spout 32 to cover the gasoline inlet opening 34 of an automobile 36. Vapor recovery nozzle 28 has two channels, one for gasoline and the other for gasoline vapors. The gasoline channel terminates in spout 32 which is inserted into gas inlet 34 to pump fuel into gasoline tank 38. When gasoline tank 38 is empty, it is filled with gas fumes and as gasoline is pumped into the gasoline tank 38, the gasoline fumes are displaced and pushed out gas inlet opening 34. Resilient boot 30 covers the gas inlet opening 34 and routes the gasoline vapors through a channel in gasoline nozzle 28 through a second hose 40 which serves as a gasoline vapor recovery hose. Gasoline vapor hose 40 is connected to the gasoline dispenser 23 and is coupled to a pressure responsive valve 44 which in turn is coupled to a rigid conduit 46. Rigid conduit 46 is coupled to the top of the underground gasoline storage tank 12 and admits the gasoline vapors thereinto.

Valve 44 serves the function of opening and closing the gasoline vapor recovery line and it is operated by differential pressure which is generated in flow sensor 24. The differential pressure generated in flow sensor 24 by a flow of gasoline therethrough is coupled to differential pressure valve 44 through conduits 48 and 50 which are frangible so that they will break in case of impact and cut off the inputs to valve 44. Frangible conduits 48 and 50 break in response to tensile force of about 500 pounds each. Valve 44 is of the normally closed type, so when its differential pressure input is cut off, either by termination of gasoline flow through flow sensor 24 or by a rupture of the frangible conduits 48 and 50, the valve closes.

Figure 2:
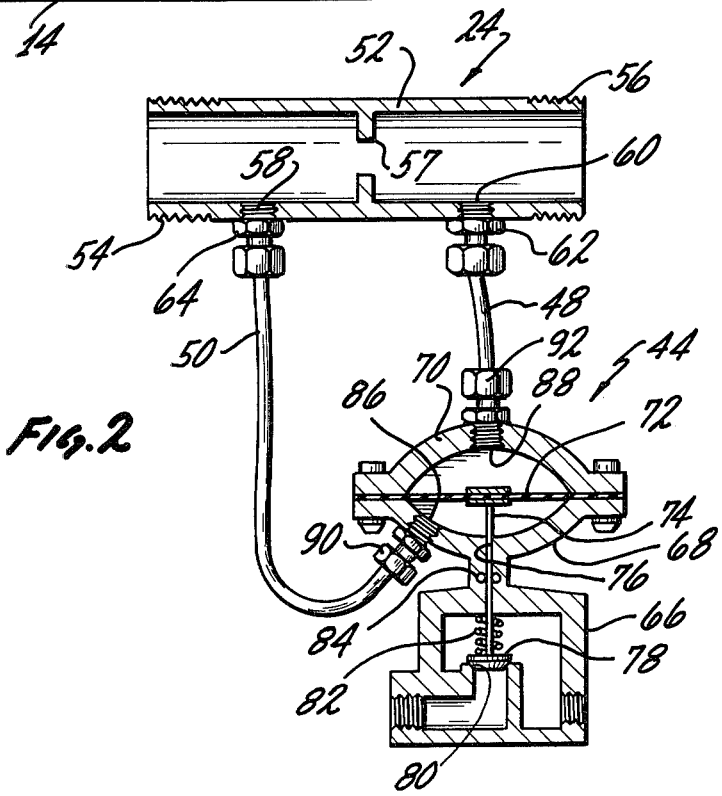
FIG. 2 is a cross-sectional view of the flow sensor and the differential pressure valve.

FIG. 2 shows the details of flow sensor 24 and pressure responsive valve 44. The flow sensor 24 is made up of sleeve 52 which is threaded at its opposite ends 54 and 56 to receive respectively a conduit from the meter 22 and a fitting from hose 26. There is an annular flow obstructor 57 mounted within the interior of sleeve 52 to obstruct the flow of gasoline slightly so as to cause a pressure differential on the opposite sides of the flow obstructor 56 by the wellknown venturi action. Threaded openings 58 and 60 are formed in sleeve 52 on the opposite sides of the flow obstructor 57 and receive plugs 62 and 64 which are attached to conduits 48 and 50.

Pressure responsive valve 44 consists of a housing 66 which has a lower concave portion 68 and a separable upper concave portion 70 which is bolted to the lower concave portion 68. A diaphram 72 is held between the two concave housing halves 68 and 70. A plunger 74 is attached to the diaphram 72 and extends through an opening 76 in valve body 66 and terminates in a valve closure element 78 which rests against the valve seat 80. Valve plunger 74 and valve closure element 78 are normally spring biased to their closed position by a spring 82 and are sealed by an O-ring seal 84. When a pressure differential with greater pressure in the lower portion of diaphram 72 is introduced, the pressure of spring 82 is overcome and valve closure element 78 is lifted off valve seat 80 to open the valve. This occurs when flow occurs through the flow sensor 24. The differential pressure from the flow sensor 24 is coupled to the opposite sides of diaphram 72 through two threaded openings 86 and 88 in housing concave portions 68 and 70 respectively. Threaded openings 86 and 88 receive plugs 90 and 92 respectively which are coupled to conduits 48 and 50.

By dividing pressure responsive valve 44 from flow sensor 24 and positioning pressure responsive valve 44 under dispenser 23, this invention eliminates the impact valve in the gasoline vapor return line that was heretofore required and provides a safer, less expensive construction. The prior art vapor recovery systems based on a unitary flow sensor and pressure responsive valve cost about $10,000, while it is estimated that the system of this invention would only cost about $8,000.

The gasoline vapor recovery system of this invention is also safer than the prior art system based on the unitary flow sensor and pressure responsive valve.

The impact valve that was used in the prior art systems closed in response to a tensile pull of 6,000 pounds, while the conduits 48 and 50 break in response to a tensile pull of 500 pounds each. When conduits 48 and 50 break, valve 44 automatically turns off and closes the gasoline vapor return line. Valve 44 is mounted so that it will require a tensile force of 4,500 pounds to pull it off its fitting, while the gasoline vapor hose 40 will pull apart under a tensile force of 250 pounds. It will be clear then, that when a car crashes into the dispenser, the hose 40 and conduits 48 and 50 will break without dislodging valve 44 and will cause valve 44 to turn off without an impact valve.

Having described our invention, we now claim:

1. A gasoline vapor recovery system comprising:
- a gasoline storage tank;
- a gasoline pump coupled to said storage tank;
- a gasoline dispenser;
- a vapor recovery nozzle;
- a gasoline delivery conduit extending from said gasoline pump, through said gasoline dispenser, and terminating in said vapor recovery nozzle;
- means on the end of said vapor recover nozzle for covering the opening in a receptacle in which gasoline is to be pumped;
- a vapor recovery conduit extending from said vapor recovery nozzle to said gasoline storage tank;
- a pressure responsive valve in said vapor recovery conduit, said valve being positioned below said dispenser;
- a flow sensor coupled to said gasoline delivery conduit above the lowest level of said dispenser; and
- conduits coupling said flow sensor to said pressure responsive valve to open said pressure responsive valve when gasoline flows through said flow sensor.

2. The gasoline vapor recovery system of claim 1, wherein the conduits extending from said flow sensor to said pressure responsive valve are frangible and break in response to tensile force of about 500 pounds each.

3. A pressure responsive valve for a gasoline vapor recovery system wherein the valve comprises:
- a housing;
- a vapor passage in said housing;
- a valve seat in said vapor passage;
- a valve closure element movable into and out of contact with said valve seat to open and close said vapor passage;
- a first cavity in said housing;
- a second cavity in said housing opposite said first cavity;
- a diaphram between said first and second cavities;
- said vapor passage being external to both of said first and second cavities;
- a plunger coupled between said diaphram and said valve closure element;
- a spring biasing said plunger to move said valve closure element to its closed position; and
- a coupling in the wall of each cavity for receiving a conduit to admit a fluid into the corresponding cavity.

4. The gasoline vapor recovery system of claim 3 wherein:
- said plunger passes through the only passage connecting said cavities and said vapor passage.

5. The pressure responsive valve according to claim 4 further including:
- a seal, bearing against said plunger, and preventing the flow of fluid from said cavities to said vapor conduit.

* * * * *

UNITED STATES PATENT AND TRADEMARK OFFICE

CERTIFICATE OF CORRECTION

PATENT NO. : 4,295,505

DATED : October 20, 1981

INVENTOR(S) : Detlev E. M. Hasselmann and Paul D. Labonte

It is certified that error appears in the above-identified patent and that said Letters Patent are hereby corrected as shown below:

Column 4, Claim 1, Line 22, please change "recover" to --recovery--.

Signed and Sealed this

*Nineteenth* Day of *January 1982*

[SEAL]

*Attest:*

GERALD J. MOSSINGHOFF

*Attesting Officer*

*Commissioner of Patents and Trademarks*